US007647658B2

(12) United States Patent
Wilson

(10) Patent No.: US 7,647,658 B2
(45) Date of Patent: Jan. 19, 2010

(54) BABY RECEIVING BLANKET HAVING POCKET FOR RECEIVING THE BABY

(75) Inventor: Elizabeth A. Wilson, Chatsworth, CA (US)

(73) Assignee: Luv My Woobie, Inc., Chatsworth, CA (US)

( * ) Notice: Subject to any disclaimer, the term of this patent is extended or adjusted under 35 U.S.C. 154(b) by 126 days.

(21) Appl. No.: 12/040,590

(22) Filed: Feb. 29, 2008

(65) Prior Publication Data

US 2009/0217455 A1 Sep. 3, 2009

(51) Int. Cl.
*A41B 13/06* (2006.01)
*A47G 9/00* (2006.01)

(52) U.S. Cl. ..... 5/482; 5/485; 2/69.5

(58) Field of Classification Search ..... 5/482, 5/494, 655, 502, 485, 496, 498; 2/69.5, 69; D6/603, 719

See application file for complete search history.

(56) References Cited

U.S. PATENT DOCUMENTS

| | | | | |
|---|---|---|---|---|
| 1,425,952 | A | 8/1922 | Fidler | |
| 2,989,753 | A | 6/1961 | Burner | |
| 3,034,132 | A * | 5/1962 | Landsberger et al. | 2/69.5 |
| 3,842,454 | A * | 10/1974 | Young | 5/413 R |
| 3,845,513 | A | 11/1974 | Hubner | |
| 4,125,903 | A | 11/1978 | Farrell | |
| 4,597,121 | A | 7/1986 | Bouma | |
| 5,058,226 | A | 10/1991 | Crosby | |
| 5,443,880 | A | 8/1995 | Wike | |
| 5,638,561 | A | 6/1997 | Sperry et al. | |
| 5,722,094 | A * | 3/1998 | Ruefer | 2/69.5 |
| D422,775 | S | 4/2000 | Hurr | |
| 6,105,168 | A * | 8/2000 | Hazen | 2/69.5 |
| 6,145,932 | A | 11/2000 | Hamel-Nyhus et al. | |
| 6,393,612 | B1 | 5/2002 | Thach et al. | |
| 6,513,164 | B1 | 2/2003 | Hearns | |
| 6,708,356 | B1 | 3/2004 | LaValle | |
| D501,350 | S | 2/2005 | Kelly et al. | |
| 7,013,507 | B2 | 3/2006 | Cook | |
| 7,065,810 | B2 | 6/2006 | Robinson | |
| D538,095 | S | 3/2007 | Turner | |

OTHER PUBLICATIONS

Two photographs of a blanket given to a person in Jan. 2006.

* cited by examiner

*Primary Examiner*—Alexander Grosz
(74) *Attorney, Agent, or Firm*—Knobbe Martens Olson & Bear, LLP

(57) ABSTRACT

A baby blanket includes a generally rectangular base cloth panel with a front face and an opposite rear face and a front cloth panel defining five edges. The front cloth panel is attached to the base cloth panel along four of the five edges so as to define a pocket between the front and base cloth panels and to define an opening into the pocket between the fifth edge of the front cloth panel and the base cloth panel, the pocket configured to receive the baby therein such that the front cloth panel covers substantially the entire torso of the baby. A plurality of tie members are attached to the front cloth panel proximate the fifth edge of the front cloth panel, the plurality of tie members configured to releasably couple to corresponding tie members attached to the base cloth panel so as to maintain the opening in a closed position and inhibit entry into the pocket when the blanket is not in use.

25 Claims, 6 Drawing Sheets

BABY RECEIVING BLANKET HAVING POCKET FOR RECEIVING THE BABY

BACKGROUND OF THE INVENTION

1. Field of the Invention

The present invention relates to blankets, and more particularly to a baby receiving blanket with a pocket for receiving the baby therein.

2. Description of the Related Art

Conventional baby blankets consist of a single layer of material (e.g., cotton, fleece or quilted material). In use, the blanket is spread into an open configuration and the baby is placed on the blanket, after which the blanket is wrapped around the baby. However, wrapping the baby in this manner with a conventional blanket requires time and effort, and is sometimes awkward. Additionally, wrapping a baby with such a blanket may not completely enclose the baby and leave gaps through which air can flow and prevent the baby from being effectively protected against, for example, wind or cold weather. Further, many conventional approaches to wrapping a baby do not adequately secure the baby in the wrap.

SUMMARY OF THE INVENTION

In accordance with one embodiment, a baby blanket is provided that comprises a generally rectangular base cloth panel having a front face and an opposite rear face, the front and rear faces comprising different materials. The baby blanket further comprises a front cloth panel defining five edges and attached to the base cloth panel so as to define a pocket between the front and base cloth panels and so as to define an opening into said pocket between a fifth edge of the front cloth panel and the base cloth panel. The pocket is configured to receive the baby therein so that the front cloth panel covers substantially the entire torso of the baby. A plurality of fastening members are attached to the front cloth panel proximate the fifth edge of the front cloth panel, said plurality of fastening members configured to be releasably coupled to corresponding fastening members attached to the base cloth panel so as to maintain the opening in a closed position and inhibit entry into the pocket when the blanket is not in use.

In accordance with another embodiment, a baby blanket is provided. The baby blanket comprises a base cloth panel having a front face and an opposite rear face and a front cloth panel sewn to the base cloth panel along all but one of the edges of the front cloth panel, said one edge defining an opening into a pocket between the front and base cloth panels. The pocket is configured to receive the baby therein, the front cloth panel defining an area of between about 75% and 80% of an area defined by the base cloth panel. The front cloth panel and the front face of the base cloth panel comprise the same material. The baby blanket also comprises a plurality of ties sewn to the front cloth panel proximate said one edge at desired intervals along the length of said edge. The plurality of ties are arranged so as to face corresponding ties sewn to the front face of the base cloth panel at a location generally opposite to the ties on the front cloth panel, said ties on the front and base cloth panels releasably coupleable to each other to maintain the opening in a closed position and inhibit entry into the pocket when the blanket is not in use. A binding is attached to the front and base cloth panels so as to define a border about the circumference of the base cloth panel.

In accordance with still another embodiment, a baby blanket is provided comprising a generally square base cloth portion having a front face and an opposite rear face. The baby blanket also comprises a front cloth portion defining five edges and attached to the base cloth panel so as to define a pocket between the front and base cloth portions and so as to define an opening into said pocket between a fifth edge of the front cloth portion and the base cloth portion. The pocket is configured to receive the baby therein so that the front cloth portion covers substantially the entire torso of the baby. A plurality of ties are sewn to the front cloth portion at predetermined intervals proximate the fifth edge of the front cloth portion, said plurality of ties releasably coupleable to corresponding ties sewn to the base cloth portion so as to maintain the opening in a closed position and inhibit entry into the pocket when the blanket is not in use.

BRIEF DESCRIPTION OF THE DRAWINGS

These and other features, aspects and advantages of the present invention will now be described in connection with a preferred embodiment of the invention, in reference to the accompanying drawings. The illustrated embodiment, however, is merely an example and is not intended to limit the invention. The drawings include the following 9 figures.

DETAILED DESCRIPTION OF THE PREFERRED EMBODIMENT

Figure 1:
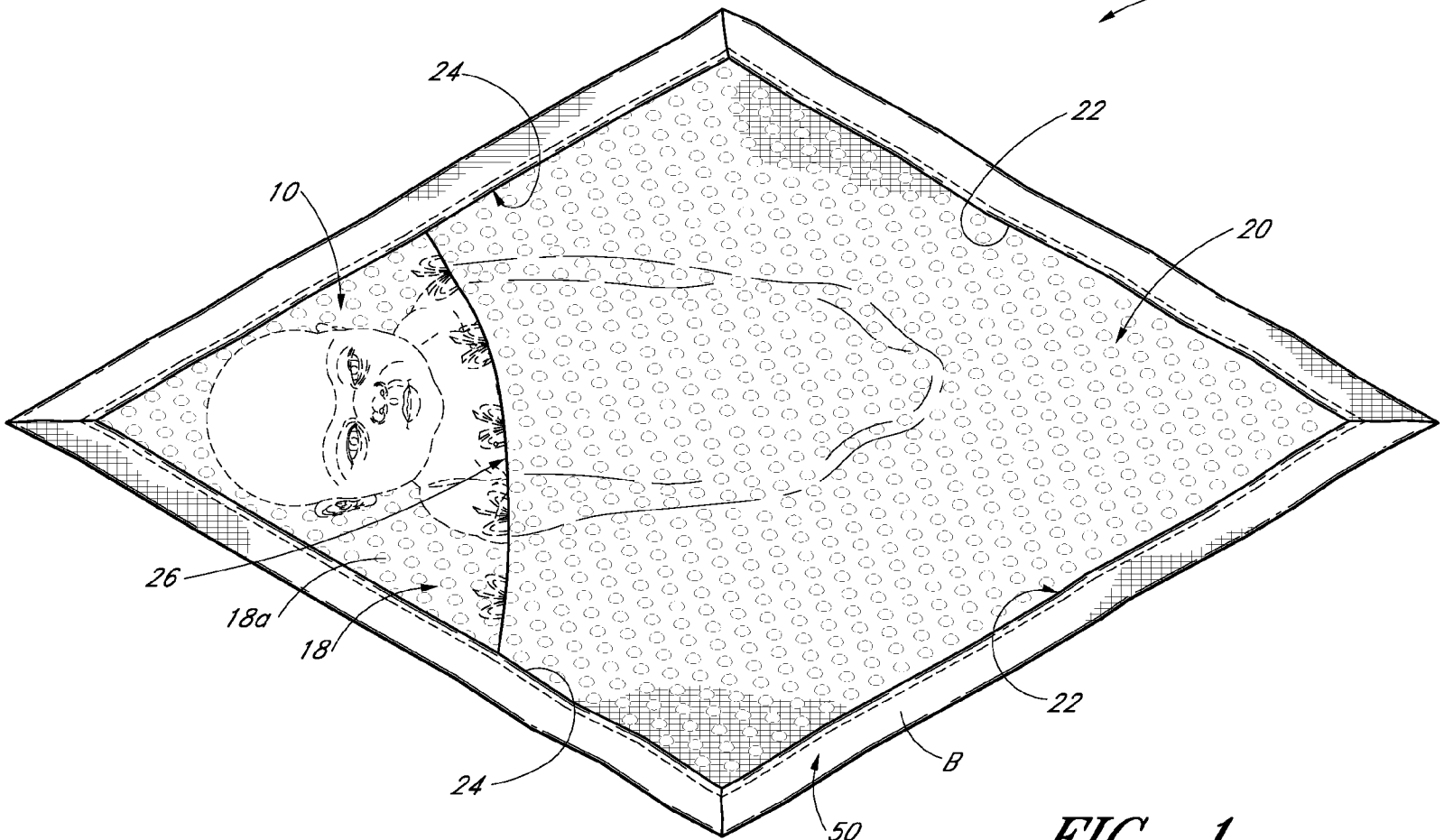
FIG. 1 is a schematic perspective view of the top side of one embodiment of the baby blanket, with a baby positioned within the blanket.
Figure 2:
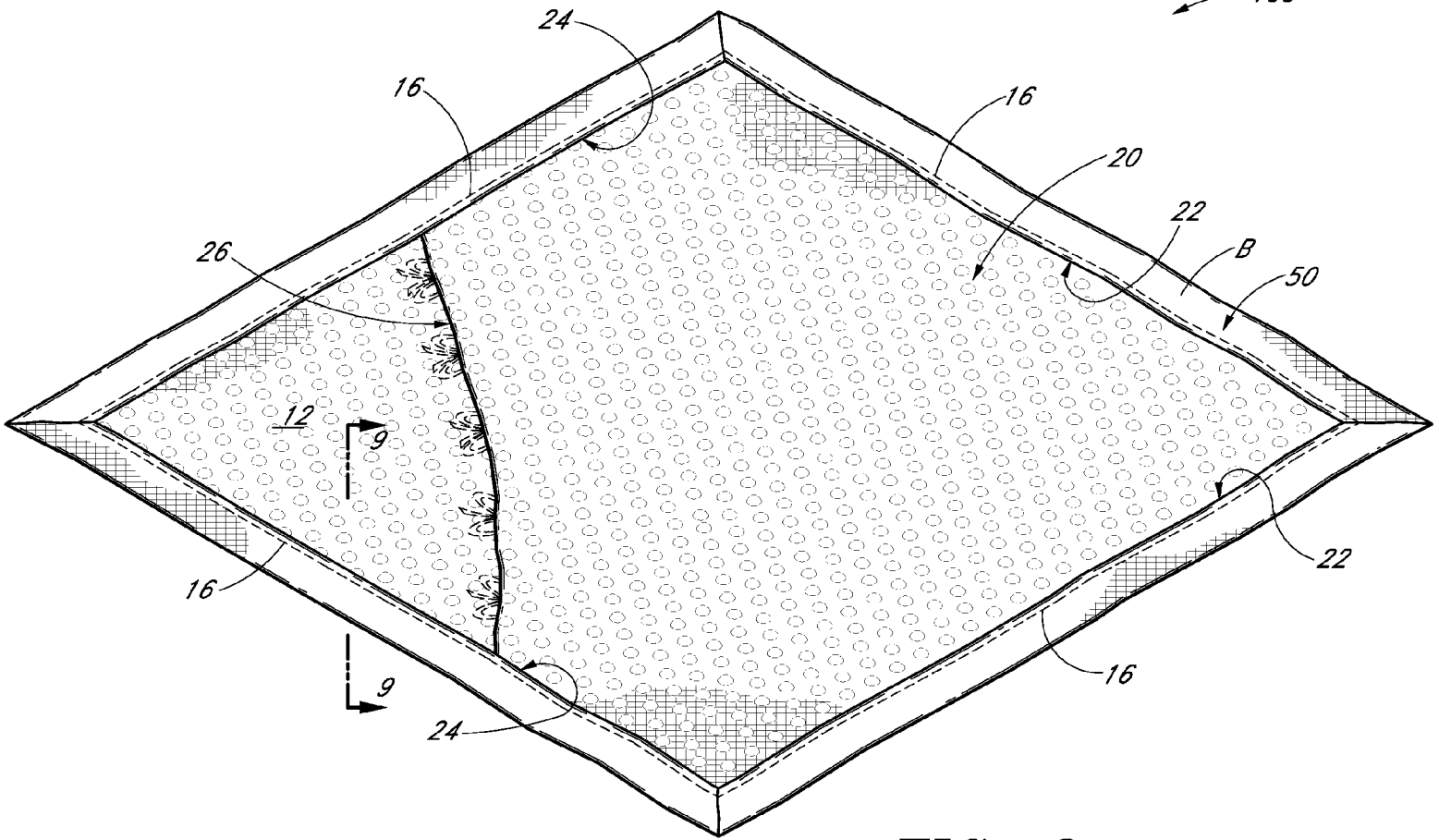
FIG. 2 is a schematic perspective view of the top side of the baby blanket illustrated in FIG. 1, without a baby positioned within the blanket.
Figure 3:
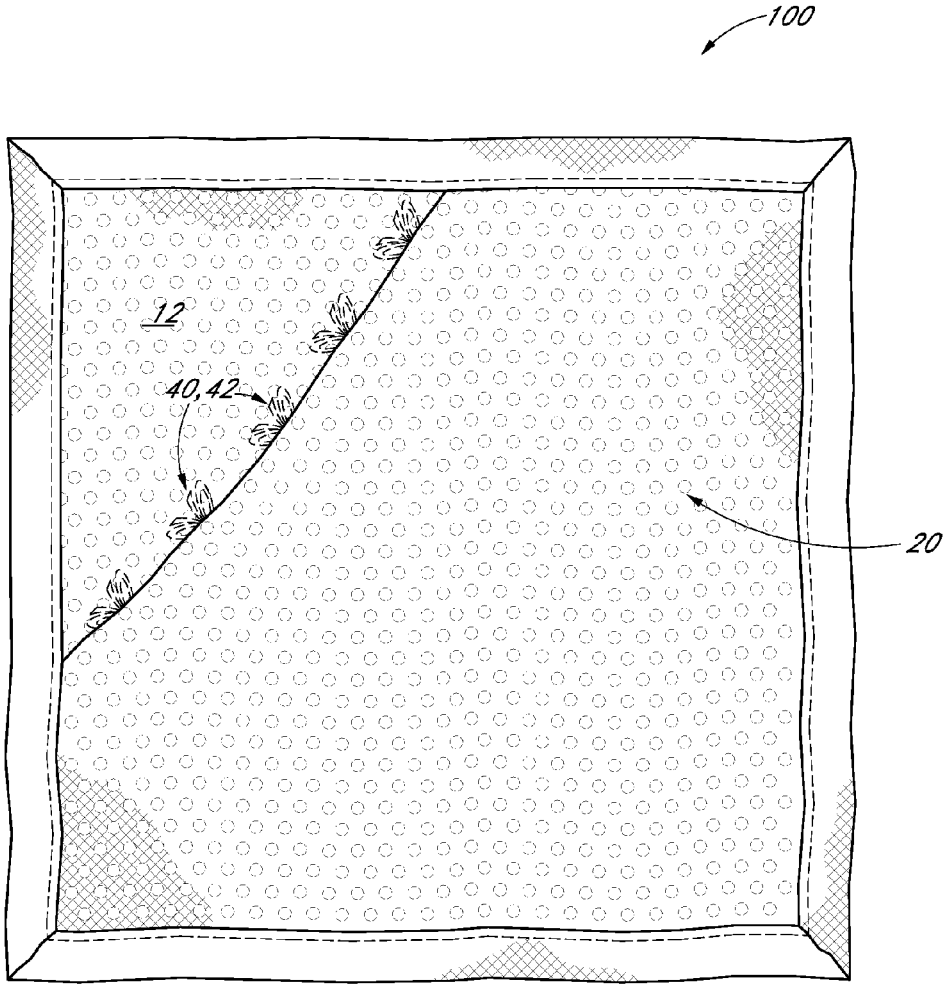
FIG. 3 is a schematic top view of the baby blanket illustrated in FIG. 2.
Figure 4:
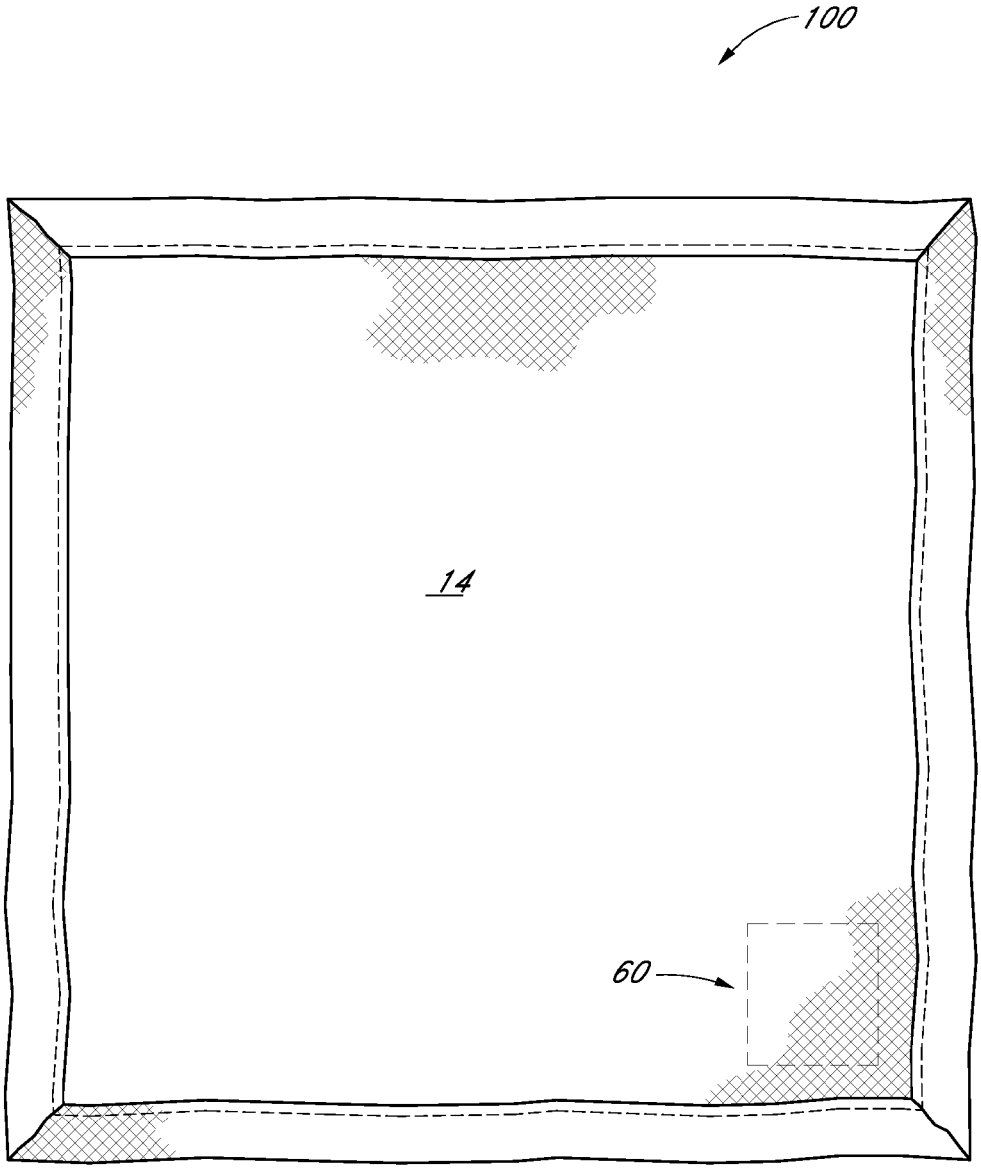
FIG. 4 is a schematic bottom view of the baby blanket illustrated in FIG. 2.
Figure 5:
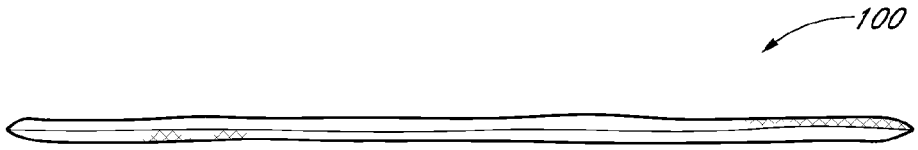
FIG. 5 is a schematic left side view of the baby blanket illustrated in FIG. 2.
Figure 6:
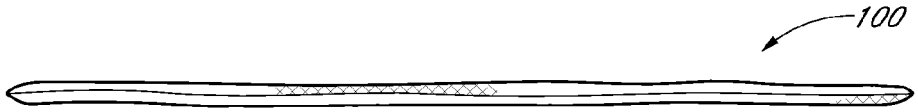
FIG. 6 is a schematic right side view of the baby blanket illustrated in FIG. 2.
Figure 7:
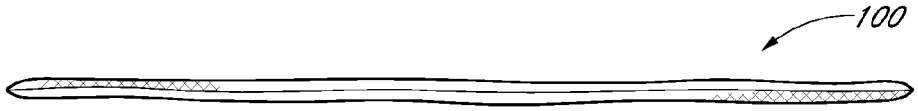
FIG. 7 is a schematic front side view of the baby blanket illustrated in FIG. 2.
Figure 8:
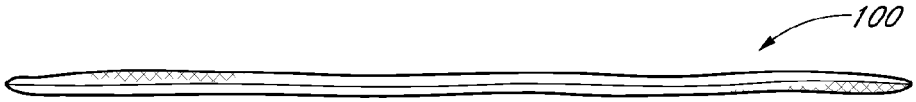
FIG. 8 is a schematic rear side view of the baby blanket illustrated in FIG. 2.
Figure 9:
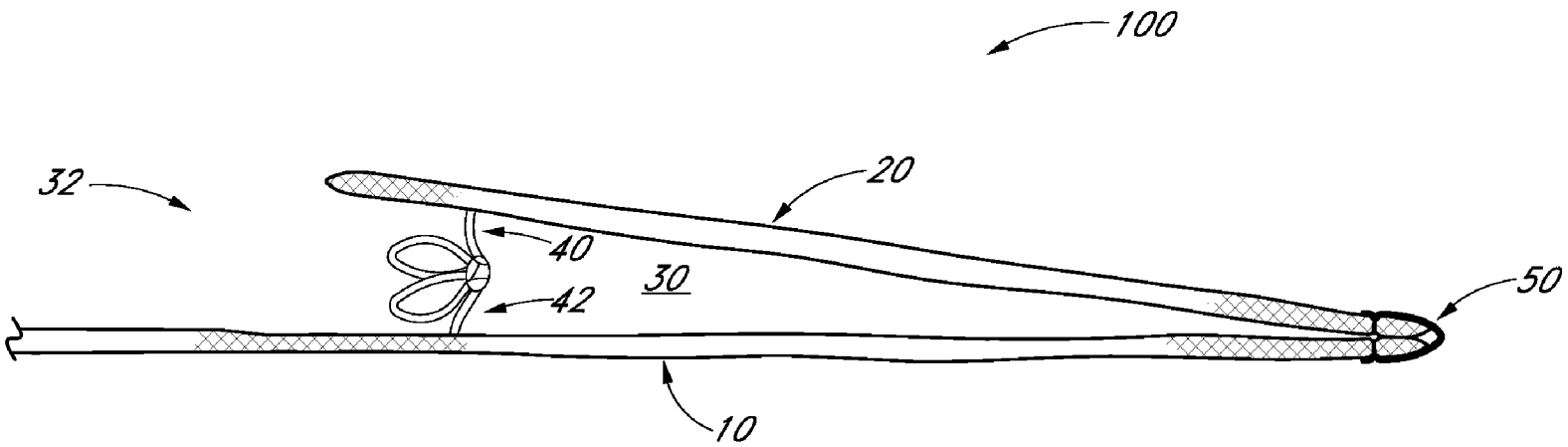
FIG. 9 is a schematic cross-sectional view of the baby blanket along line 9-9 in FIG. 2.

In the following detailed description, terms of orientation such as "front" and "rear" are used herein to simplify the description of the context of the illustrated embodiments. Likewise, terms of sequence, such as "first" and "second," are used to simplify the description of the illustrated embodiments. Because other orientations and sequences are possible, however, the present invention should not be limited to the illustrated orientation. Those skilled in the art will appreciate that other orientations of the various components described above are possible.

FIGS. 1-9 illustrated one embodiment of a baby blanket 100. The baby blanket 100 has a base cloth panel or portion 10 with a front face 12 one side of the blanket 100 and a rear face 14 on an opposite side of the blanket 100. In one embodiment, the base cloth panel 100 can have a rectangular shape with edges 16. In another embodiment, the base cloth panel can have a square shape. However, in other embodiments the base cloth panel 10 can have other polygonal shapes, or can have a circular or oval shape.

The front face 12 of the base cloth panel 10 preferably is of a soft material. For example, in one embodiment, the front face 12 can be made of chenille (e.g., manufactured using cotton, acrylic, rayon and/or olefin yarn). In one embodiment, the front face 12 can be of a different material than the rear face 14 of the base cloth panel 10. For example, the rear face 14 can be made of flannel, cotton or satin. In another embodiment, the front and rear faces 12, 14 of the base cloth panel 10 can be of the same material. Additionally, at least one of the front and rear faces 12, 14 can have a textured surface 18, such as a raised spots 18*a* or portions, which can provide a desired pattern on the base cloth panel 10. In another embodiment, the front and rear faces 12, 4 of the base cloth panel can have different textures. By way of example, the pattern can include a geometric pattern, images of animals, images of inanimate objects (e.g., planes, boats, bicycles, clothing), images of plants, images of nature (mountains, clouds, oceans, etc.), etc.

In the illustrated embodiment, the baby blanket 100 also includes a front cloth panel or portion 20 with two long edges 22, each long edge 22 preferably having approximately the same length as the edge 12 of the base cloth panel 10. The front cloth panel 20 can also include two short edges 24, each short edge 24 preferably having a length shorter than the length of the edge 12 of the base cloth panel 10. In one embodiment, the length of the short edge 24 is between about 10% and about 80% of the length of the edge 12 of the base cloth panel 10. In another embodiment, the length of the short edge 24 is between about 30% and about 50% of the length of the edge 12 of the base cloth panel 10. In still another embodiment, the length of the short edge 24 is about 40% of the length of the edge 12 of the base cloth panel 10. In one embodiment, the front cloth panel 20 defines an area that is between about 60% and 85% of the area defined by the base cloth panel 10. In another embodiment, the front cloth pane 20 defines an area that is between about 75% and about 80% of the area defined by the base cloth panel 10. In still another embodiment, the front cloth panel 20 defines an area that is approximately 78% of the area of the base cloth panel 10.

In one embodiment, the front cloth panel 20 is separate from the base cloth panel 10. In another embodiment, the front cloth panel or portion 20 and the base cloth panel or portion 10 form a continuous cloth panel The front cloth panel 20 is preferably attached along its edges 22, 24 to the edges 12 of the base cloth panel 10. For example the front cloth pane 10 can be sewn (e.g., by hand or with a sewing machine) to the base cloth panel 20. However, any suitable manner can be used to attach the front cloth panel 10 to the base cloth panel 20 (e.g. glue, tape, etc.). The front cloth panel 20 also includes a free edge 26 that extends across at least a portion of the base cloth panel 10 when the front cloth panel 20 is placed on top of the base cloth panel 10 and the edges 22, 24 of the front cloth panel are aligned with the edges 12 of the base cloth panel 10. Preferably, the front cloth panel 20 is of a soft material. In one embodiment, the front cloth panel 20 can be of chenille. However, the front cloth panel 20 can be of other suitable materials.

In one embodiment, the front cloth panel 20 is separate from the base cloth panel 10. In another embodiment, the front cloth panel or portion 20 and the base cloth panel or portion 10 form a continuous cloth panel. For example, the base cloth portion 10 and front cloth portion 20 can define an elongated rectangular blanket when in an extended configuration, and the front cloth portion 20 can be folded onto the base cloth portion 10 so that the edges 22, 24 of the front cloth portion 20 align with the edges 12 of the base cloth portion 10, thereby defining a generally square-shaped blanket.

With reference to FIG. 1, the base cloth panel 10 and front cloth panel 20 define a pocket 30 therebetween that can receive a baby therein. Additionally, the free edge 26 of the front cloth panel 20 and the base cloth panel 10 define an opening 32 into the pocket 30. Advantageously, the front cloth panel 20 is dimensioned relative to the base cloth panel 10 such that the front cloth panel 20 covers substantially the entire torso of the baby so as to keep the baby warm. In one embodiment, the pocket 30 can be sized such that the free edge 26 extends across the baby proximate its shoulders. Advantageously, the baby's head can rest on the base cloth panel 10 so that the baby's head is maintained warm. In one embodiment, the baby blanket 100 can be laid flat on a surface, such as a bed or crib, and the baby placed within the pocket 30 of the baby blanket 100. In another embodiment, the side and bottom corners of the baby blanket 100 can be folded onto the blanket 100 after the baby has been placed within the pocket 30.

With continued reference to FIG. 1, the baby blanket 100 can include a plurality of fasteners 40 for releasably fastening the front cloth panel 20 proximate the free edge 26 to the base cloth panel 10. In one embodiment, the fasteners 40 are attached to a rear side of the front cloth panel 20 opposite the front face 12 of the base cloth panel 10 an positioned at desired intervals (e.g., equidistant intervals) along the length of the free edge 26. In one embodiment, the fasteners 40 are spaced at intervals of about 3 inches.

The fasteners 40 can be releasably coupled to corresponding fasteners 42 attached to the front face 12 of the base cloth panel 10 and positioned generally opposite the fasteners 40. The fasteners 40, 42 preferably allow the front cloth panel or portion 20 to be fastened to the base cloth panel or portion 10 when the baby blanket 100 is not in use (e.g., when the baby is not disposed within the pocket 30 of the blanket 100) to thereby close the opening 32 and inhibit entry into the pocket 30.

In the illustrated embodiment, the fasteners 40, 42 are tie members 40, 42 (e.g., thin bands of flexible material, such as ribbons, manufactured from cloth (e.g., silk) or plastic), that are attached (e.g., sewn) to the front cloth panel or portion 20 an the front face 12 of the base cloth panel or portion 10 generally opposite each other, and which can be selectively tied and untied to close and open the opening 32, respectively. However, the fasteners 40, 42 can be any suitable fastening mechanism, such as, for example, hook and loop fasteners (e.g., VELCRO®). The ties members may be of a gender neutral color (e.g., yellow, red, or green) or of a color typically associated with a specific gender (e.g., pink for girls, blue for boys). The color may be selected to coordinate with or contrast with the colors on one or more of the panels discussed above. Optionally, different ties can have corresponding different colors. The ties members are preferably attached to the front cloth panel 20 at a location between about ½ inch and 1½ inches below the free edge 26 of the front cloth panel 20. Accordingly, the tie members 40, 42 can attach the front cloth panel 20 to the base cloth panel 10 while being substantially out of sight or hidden from view. In another embodiment, the tie members 40, 42 can be attached to the front cloth panel 20 at a location approximately ¾ inch below the free edge 26 of the front cloth panel 20. The tie member 40, 42 can be of a satin material. However, the tie members 40, 42 can be of any suitable material.

The baby blanket 100 further comprises a binding 50 that extends about the edges 12 of the base cloth panel 10 and the long and short edges 22, 24 of the front cloth panel 20 so as to provide a border B around the blanket 100. The binding 50 can be attached to the front and base cloth panels 20, 10 using any suitable mechanism (e.g., sewn by hand or with a sewing machine). The border B can have a width of between about ½ inch and 3 inches, and more preferably a width of about 2 inches. In one embodiment, the binding 50 can be of satin. However, the biding 50 can be of any suitable material.

In one embodiment, the baby blanket 100 can have a label 60 on the rear face 14 of the base cloth panel 10, for example, proximate a corner of the blanket 100. However, in another embodiment, the label 60 can also be on the front cloth panel 20 and can be framed with material from the front cloth panel 20. In one embodiment, the label 60 can be sewn on top of a surface of the blanket 100. In another embodiment, the label 60 can be flush with a surface of the blanket 100. For example, the label 60 can in one embodiment be weaved along with the fabric of the base cloth panel 10.

Although these inventions have been disclosed in the context of a certain preferred embodiments and examples, it will be understood by those skilled in the art that the present inventions extend beyond the specifically disclosed embodiments to other alternative embodiments and/or uses of the inventions and obvious modifications and equivalents thereof. In addition, while a number of variations of the inventions have been shown and described in detail, other modifications, which are within the scope of the inventions, will be readily apparent to those of skill in the art based upon this disclosure. It is also contemplated that various combinations or subcombinations of the specific features and aspects of the embodiments may be made and still fall within one or more of the inventions. Accordingly, it should be understood that various features and aspects of the disclosed embodiments can be combine with or substituted for one another in order to form varying modes of the disclosed inventions. Thus, it is intended that the scope of the present inventions herein disclosed should not be limited by the particular disclosed embodiments described above.

What is claimed is:

1. A baby blanket, comprising:

a base cloth panel having a generally polygonal shape with a front face and an opposite rear face;

a front cloth panel comprising five edges and attached to the base cloth panel along all but one of the edges of the front cloth panel, said one edge being a free edge that defines an opening into a pocket between the front and base cloth panels, the pocket configured to receive the baby therein so that the front cloth panel covers substantially the entire torso of the baby, the front cloth panel defining an area of at least 75% of an area defined by the base cloth panel; and a plurality of fastening members attached to the front cloth panel proximate the free edge of the front cloth panel, said plurality of fastening members configured to be releasably coupled to corresponding fastening members attached to the base cloth panel so as to selectively maintain the opening in a closed position and inhibit entry into the pocket when the blanket is not in use.

2. The baby blanket of claim 1, wherein the base cloth panel has a square shape.

3. The baby blanket of claim 1, wherein the front cloth panel and the front face of the base cloth panel comprise the same material.

4. The baby blanket of claim 1, wherein the front face of the base cloth panel comprises a chenille material.

5. The baby blanket of claim 1, wherein the rear face of the base cloth panel comprises a material chosen from the group consisting of flannel, cotton and satin.

6. The baby blanket of claim 1, wherein the front and rear faces of the front cloth panel comprise different materials.

7. The baby blanket of claim 1, wherein the fastening members attached to the front and base cloth panels comprise ties that can be removably tied to each other to generally close the opening into the pocket.

8. The baby blanket of claim 1, wherein the fastening members are sewn to the front cloth panel at a location between about ½ inch and 1½ inches below the free edge of the front cloth panel so as to face corresponding fastening members sewn to the front face of the base cloth panel at a location opposite to the fastening members on the front cloth panel.

9. The baby blanket of claim 1, wherein the fastening members are spaced at intervals along the opening of the pocket of about 3½ inches.

10. The baby blanket of claim 1, wherein the fastening members include ribbons.

11. The baby blanket of claim 1, further comprising a binding extending over the front and base cloth panels along the edges of the base cloth panel.

12. The baby blanket of claim 11, wherein the binding is a satin binding that provides a border about the circumference of the base cloth panel, the border having a width of about 2 inches.

13. The baby blanket of claim 1, further comprising a label attached to the rear face of the base cloth panel such that the label is flush with the rear face.

14. The baby blanket of claim 1, further comprising a label flush with a surface of the blanket.

15. A baby blanket, comprising:

a base cloth panel having a generally square shape with a front face and an opposite rear face;

a front cloth panel comprising five edges and sewn to the base cloth panel along all but one of the edges of the front cloth panel, said one edge being a free edge that defines an opening into a pocket between the front and base cloth panels, the pocket configured to receive the baby therein, the front cloth panel defining an area of at least 75% of an area defined by the base cloth panel;

a a plurality of fastening members attached to the front cloth panel proximate the free edge of the front cloth panel, said plurality of fastening members configured to be releasably coupled to the base cloth panel so as to selectively maintain the opening in a closed position and inhibit entry into the pocket when the blanket is not in use; and a binding attached to the front and base cloth panels and defining a border about the circumference of the base cloth panel.

16. The baby blanket of claim 15, wherein the front cloth panel and the front face of the base cloth panel comprise the same material.

17. The baby blanket of claim 15, wherein the fastening members are sewn to the front cloth panel at a location between about ½ inch and 1½ inches below the free edge of the front cloth panel.

18. The baby blanket of claim 15, wherein the front and rear faces of the base cloth panel comprise different materials.

19. The baby blanket of claim 15, wherein the front face of the base cloth panel comprises chenille.

20. The baby blanket of claim 15, wherein the rear face of the base cloth panel comprising a material chosen from the group consisting of flannel, cotton and satin.

21. A baby blanket, comprising:

a generally rectangular base cloth portion having a front face and an opposite rear face;

a front cloth portion comprising five edges and attached to the base cloth panel along all but one of the edges of the front cloth portion, said one edge being a free edge that defines an opening into a pocket between the front and base cloth portions, the pocket configured to receive the baby therein, the front cloth portion defining an area of at least 75% of an area defined by the base cloth portion; and a plurality of fasteners sewn to the front cloth portion proximate the free edge of the front cloth portion, said plurality of fasteners releasably coupleable to the base cloth portion so as to selectively maintain the opening in a closed position and inhibit entry into the pocket when the blanket is not in use.

22. The baby blanket of claim 21, wherein the base cloth portion and the front cloth portion define a continuous cloth panel.

23. The baby blanket of claim 21, further comprising a binding attached to the front and base cloth portions and defining a border about the circumference of the base cloth portion.

24. The baby blanket of claim 21, wherein the fasteners are sewn to the front cloth portion at a location between about ½ inch and 1½ inches below the free edge of the front cloth portion.

25. The baby blanket of claim 21, wherein the fasteners comprises ties of a ribbon material.

* * * * *

UNITED STATES PATENT AND TRADEMARK OFFICE

CERTIFICATE OF CORRECTION

PATENT NO. : 7,647,658 B2
APPLICATION NO. : 12/040590
DATED : January 19, 2010
INVENTOR(S) : Elizabeth A. Wilson It is certified that error appears in the above-identified patent and that said Letters Patent is hereby corrected as shown below:

Column 3, line 39, after "panel", please insert --.--, therefor.

Column 4, line 24, please delete "3", and insert --3½--, therefor.

Column 6, line 36, before "a", please delete "a", therefor.

Signed and Sealed this

Twenty-ninth Day of June, 2010

David J. Kappos

David J. Kappos
*Director of the United States Patent and Trademark Office*